US005749794A

United States Patent [19]

Kobayashi et al.

[11] Patent Number: 5,749,794

[45] Date of Patent: May 12, 1998

[54] GOLF CLUB HEAD

[75] Inventors: Kenji Kobayashi; Hitoshi Takeda, both of Tsubame, Japan

[73] Assignee: Kabushiki Kaisha Endo Seisakusho, Niigata-Ken, Japan

[21] Appl. No.: 521,951

[22] Filed: Aug. 31, 1995

Related U.S. Application Data

[63] Continuation-in-part of Ser. No. 245,971, May 19, 1994, Pat. No. 5,522,593.

[30] Foreign Application Priority Data

| | | | |
|---|---|---|---|
| May 31, 1993 | [JP] | Japan | 5-129608 |
| Aug. 27, 1993 | [JP] | Japan | 5-213039 |
| Mar. 31, 1994 | [JP] | Japan | 6-63532 |
| Mar. 31, 1994 | [JP] | Japan | 6-63538 |
| Mar. 23, 1995 | [JP] | Japan | 7-64025 |

[51] Int. Cl.[6] ..... A63B 53/04

[52] U.S. Cl. ..... 473/342; 473/349; 473/350

[58] Field of Search ..... 473/324, 334, 473/335, 336, 337, 338, 339, 342, 347, 348, 349, 350

[56] References Cited

U.S. PATENT DOCUMENTS

| | | | |
|---|---|---|---|
| 922,444 | 5/1909 | Youds . | |
| 1,320,163 | 10/1919 | Maurice | 473/335 |
| 1,567,248 | 12/1925 | Dahlman . | |
| 1,678,637 | 7/1928 | Drevitson . | |
| 1,968,092 | 7/1934 | Oldham . | |
| 1,968,627 | 7/1934 | Young . | |
| 2,846,228 | 8/1958 | Reach . | |
| 3,220,733 | 11/1965 | Saleeby . | |
| 3,814,437 | 6/1974 | Winquist | 473/324 |
| 3,847,399 | 11/1974 | Raymont . | |
| 4,027,885 | 6/1977 | Rogers . | |
| 4,326,326 | 4/1982 | MacDonald . | |
| 4,523,759 | 6/1985 | Igarashi . | |
| 4,708,347 | 11/1987 | Kobayashi | 473/338 |
| 4,824,110 | 4/1989 | Kobayashi | 473/347 |
| 4,852,880 | 8/1989 | Kobayashi | 473/349 |
| 4,874,171 | 10/1989 | Ezaki et al. . | |
| 4,883,275 | 11/1989 | Boone | 473/334 |
| 4,884,812 | 12/1989 | Nagasaki | 473/342 |
| 4,984,800 | 1/1991 | Hamada . | |
| 5,082,278 | 1/1992 | Hsien | 473/335 |
| 5,190,290 | 3/1993 | Take | 473/348 |
| 5,275,413 | 1/1994 | Sprague . | |
| 5,346,213 | 9/1994 | Yamada | 473/342 |
| 5,425,535 | 6/1995 | Gee | 473/342 |
| 5,439,223 | 8/1995 | Kobayashi | 473/334 |

*Primary Examiner*—Sebastiano Passaniti
*Attorney, Agent, or Firm*—Quarles & Brady

[57] ABSTRACT

A golf club head having a larger sweet area for easier visual confirmation by a player when adressing a ball. Head body 1 is provided with denser weight at its back, thus displacing CG toward a back side of the head body 1 to enlarge a depth Le of CG and sweet area. The back of the head body 1 is located on the same plane relative to the back 6A of the weight 6, thus eliminating an obstacle to view when a player addresses a ball to enhance the concentration of the player. The back of the head body 1 is annularly formed with thickened portion 1B so that the entire periphery of the back is suitably weighted with titanium, aluminium or the alloy thereof. Owing to such dispersed weight distribution, a player can be free from a sense of unstability and accuratetly strike a ball if the ball is struck a little off the center of face 2.

12 Claims, 10 Drawing Sheets

GOLF CLUB HEAD

CROSS REFERENCE TO RELATED APPLICATIONS

This application is a continuation-in-part of U.S. application Ser. No. 08/245,971 filed on May 19, 1994, now U.S. Pat. No. 5,522,593. The application hereinabove is incorporated herein and is a part thereof.

BACKGROUND OF THE INVENTION (a) Field of the Invention

The present invention relates to a golf club head, especially relates to so-called an iron golf club head, a putter golf club head or a pitching golf club head.

(b) Description of Prior Art

For example, U.S. Pat. Ser. No. 4,874,171 discloses in its FIG. 5 a golf club head provided with sythetic resin containing reinforcing fiber (the specific gravity ranging from 2 to 4) on metallic sole at the back of face. The prior head has the upper end of the synthetic resin member connected to the upper end of face, while the lower end thereof connected to the back end of sole having protrusion thereon. Further, the back surface of the synthetic resin member is formed with arc-shaped convex curved surface.

It is well acknowledged that you can enlarge a sweat area in a golf club head by elongating the depth of the CG of the head (i.e.,elongating the distance between the face and the center of gravity.) and having the weight distribution of face biased toward periphery of the head. Particularly, such weight distribution is effective in preventing the unsteadiness of the head in striking balls, since an ordinary head is unstable unless balls are struck at the center of face.

According to the prior head shown in FIG. 5 of U.S. Pat. No. 4,874,171, although the center of gravity can be postioned backward by providing the protrusion in the center of sole, the head is too partially weighted at sole side, therefore, there is no consideration for enlarging sweet area by dispersing the weight distribution on face.

In addition, when a player addresses a ball prior to striking the same, he is generally required to carefully choose the positional relationship between the face and the ball. According to U.S. Pat. No. 4,874,171, however, as the back surface of the synthetic resin member is formed with arc-shaped convex curved surface, such convex curved surface will be an obstacle to addressing a ball.

SUMMARY OF THE INVENTION

To eliminate the above-mentioned problems, it is, therefore, an object of the present invention to provide a golf club head which has a larger sweet area.

It is another object of the present invention to provide a golf club head of which the balance weight will not disturve a player's concentration in addressing balls.

According to a major feature of the present invention, a golf club head comprises: a head body having a face at its front and a concave portion at its back, said concave portion being defined by a rear surface of the head body and a peripheral portion of the back; a balance weight made of material denser than that of said head body which, is secured into said concave poriton, the back of said head body being located on the same plane relative to a back of said weight, wherein said peripheral portion is thickened such that a depth of said concave portion is greater at its lower side than at its upper side, while a height thereof is greater at its inside than at its outside.

BRIEF DESCRIPTION OF THE DRAWINGS

Other objects, features and advantages of the invention will be apparent to those skilled in the art from the following description of the preferred embodiments of the invention, wherein reference is made to the accopmpanying drawings, of which.

FIG. *6a* is a section showing a fourth embodiment of the invention.

FIG. *6b* is an enlarged view of a section showing a fourth embodiment of the invention.

Figure 7:
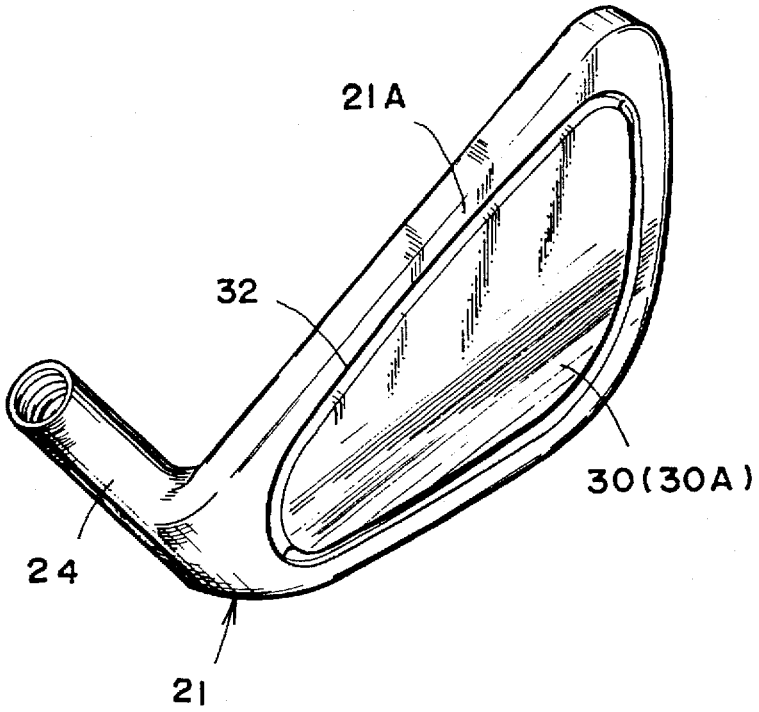

FIG. 7 is a perspective view showing a fourth embodiment of the invention.

Figure 8:
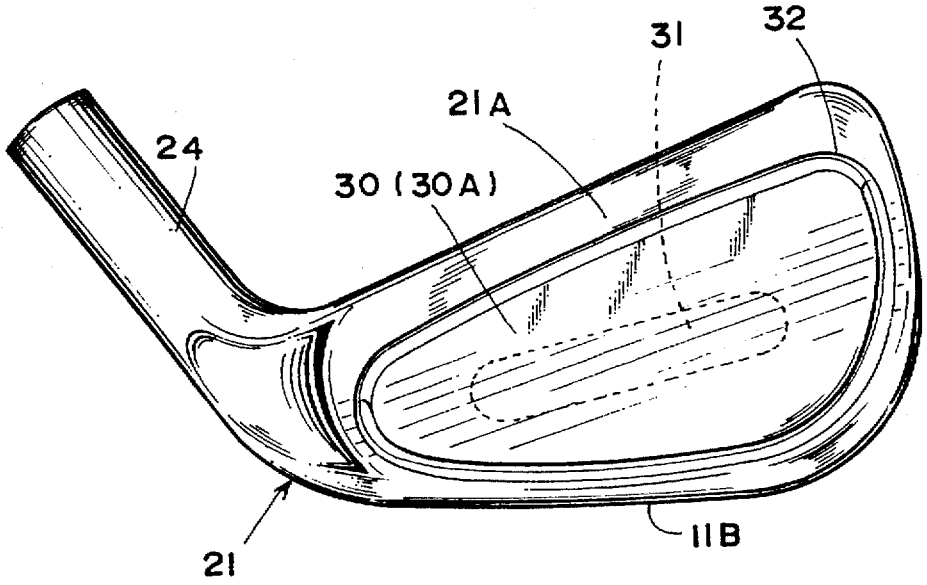

FIG. 8 is a rear view showing a fourth embodiment of the invention.

Figure 9:
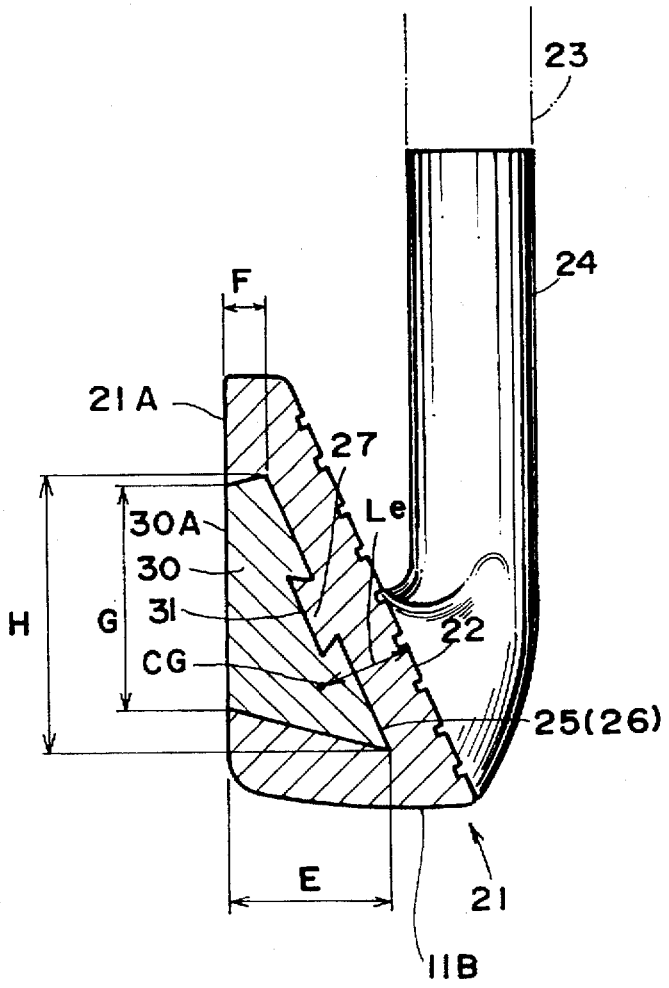

FIG. 9 is a section showing a fifth embodiment of the invention.

Figure 10:
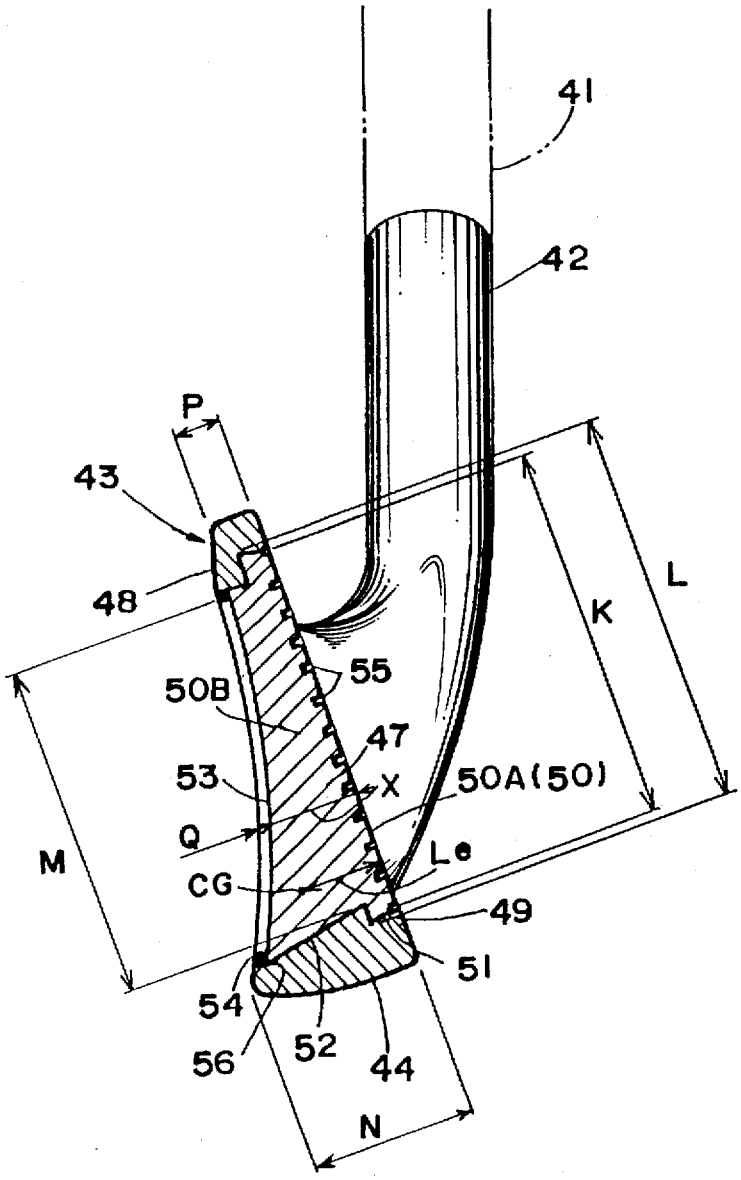

FIG. 10 is a section showing a sixth embodiment of the invention.

Figure 11:
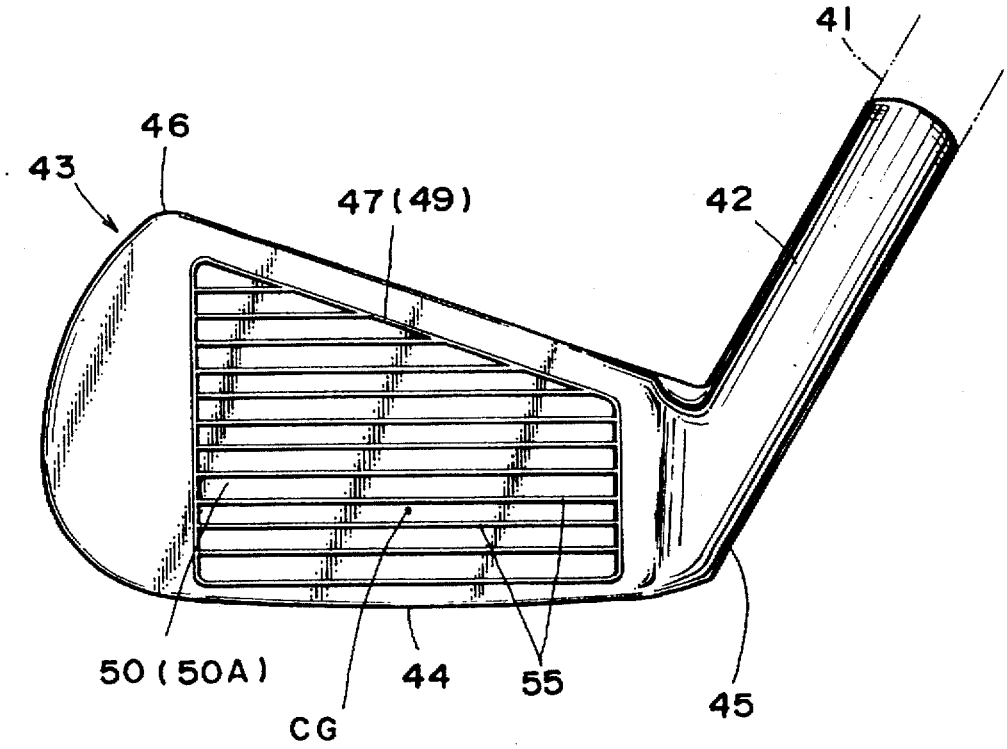

FIG. 11 is a perspective view showing a sixth embodiment of the inveniton.

Figure 12:
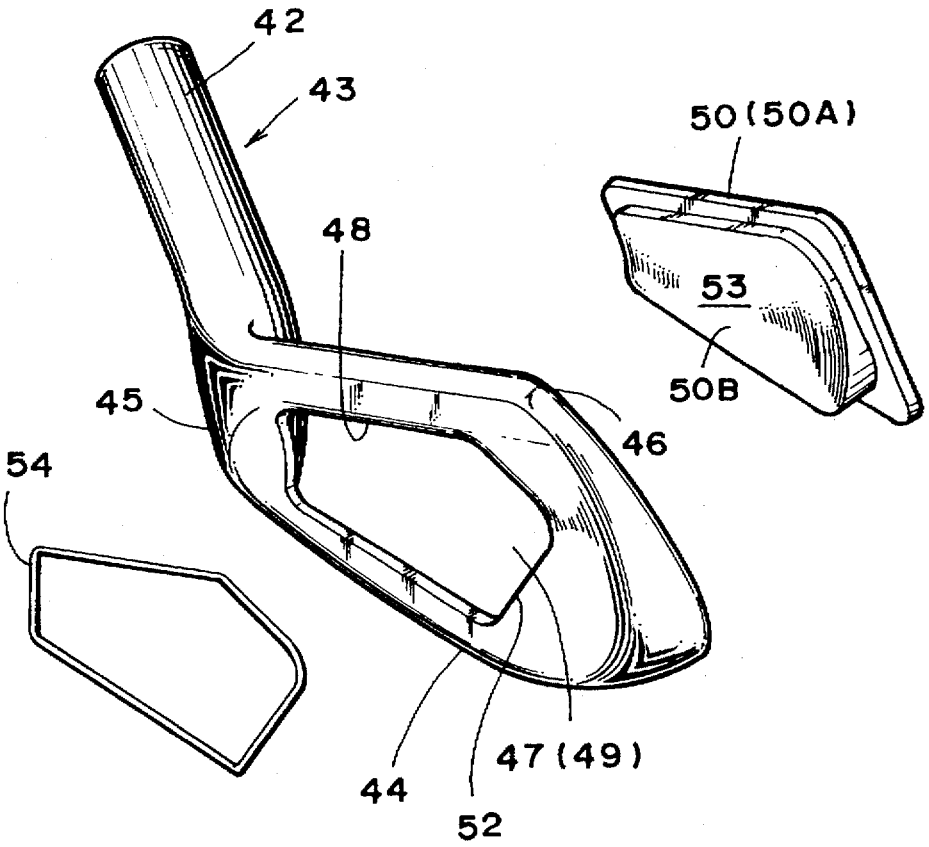

FIG. 12 is an exploded perspective view showing a sixth embodiment of the invention.

DETAILED DESCRIPTION OF THE PREFERRED EMBODIMENTS

Figure 2:
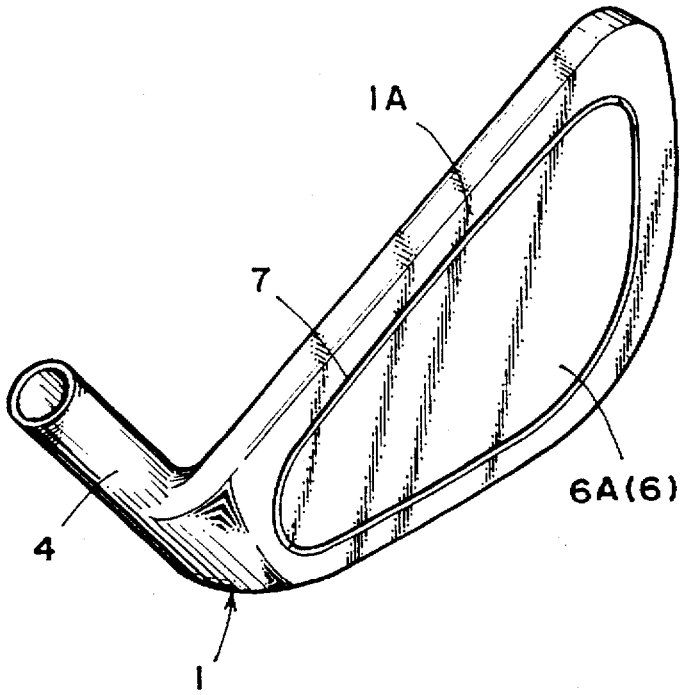
FIG. 2 is a perspective view showing a first embodiment of the invention.
Figure 3:
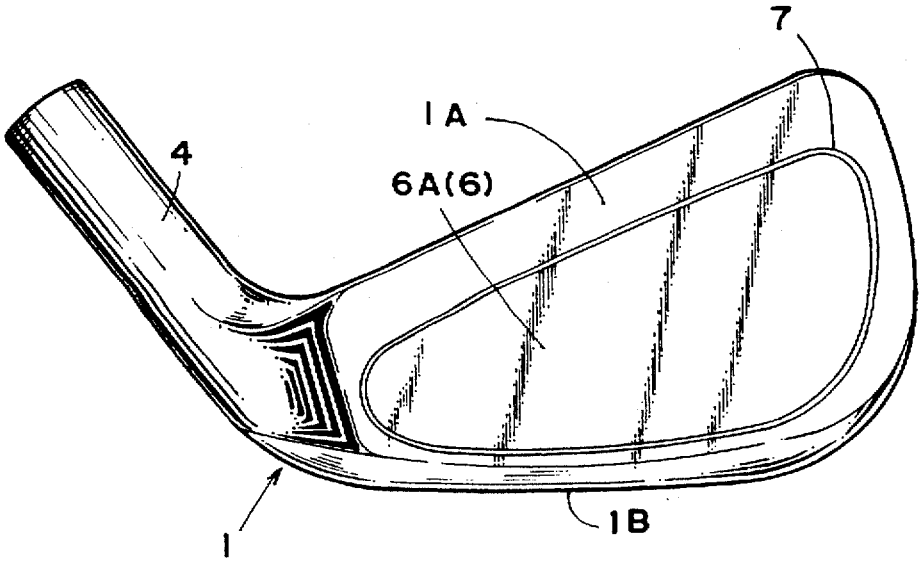
FIG. 3 is a rear view showing a first embodiment of the present invention.

Hereinafter is described a first embodiment of the present invention with reference to FIGS. 1 to 3.

Figure 1:
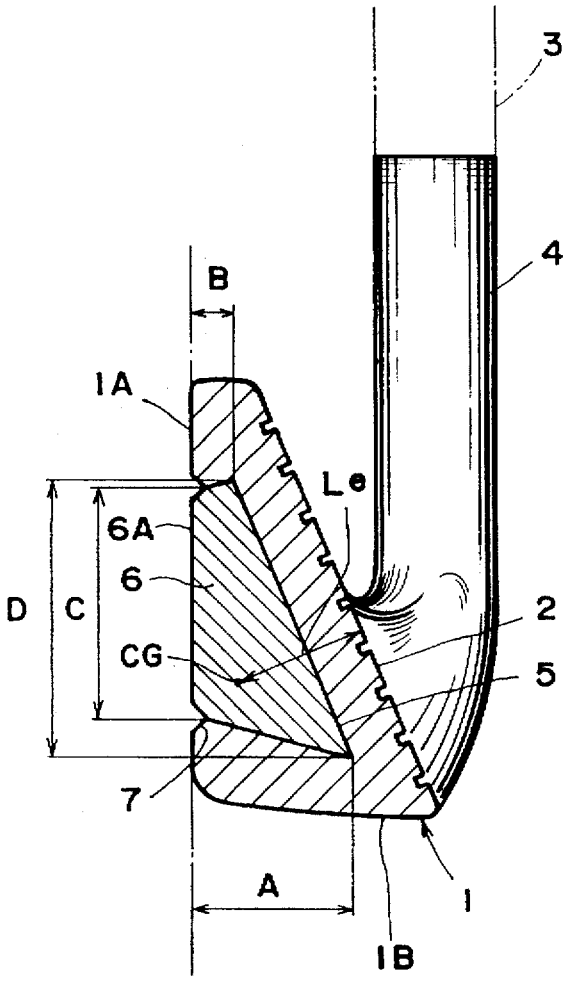
FIG. 1 is a section showing a first embodiment of the invention.

Referring to FIG. 1, reference numeral 1 designates a head body made of titanium, aluminium or the alloy thereof, having face 2 inclined at a preset angle at its front side, neck 4 at one side for connecting shaft 3 thereto. The back of the head body 1 is formed with concave portion 5 having entire periphery of thickened portion 1A, thus forming sole 1B at its bottom side.

The depth A of a lower portion of the concave portion 5 is formed greater than the depth B of the upper portion thereof, while the height D of the inside or front portion greater than the height C of the outside or back portion thereof.

The weight 6 to be provided in the concave portion 5 is formed of comparatively denser materials, such as iron, copper, beryllium copper alloy or lead, which is pressed into the concave portion 5 by means of a pressing device or the like, thus securing the same to the head body 1. In such pressing-in and securing operation, the back surface of the head body 1 is formed on the same plane relative to back surface 6A of weight 6, as shown in a dotted line of FIG. 1. In the boundary portion between back surface 1A and 6A is provided a small groove 7 having V-shaped section as an ornament, which is colored red or the like (not shown).

With the structure thus made, as weight 6 denser than head body 1 is provided in the back thereof, the CG thereof can be positioned backward, thus elongating the depth Le of the CG to enlarge sweet area. Further, the concave portion 5 has such a dovetail structure that the lower depth A is formed greater than the upper depth B, while the comparatively inside height D greater than the comparatively outside height C, thereby ensuring the securing of the head body 1 to the weight 6, and thus further elongating the depth Le of the CG since the center of gravity (not shown) of weight 6 itself is lowered and positioned backward. Furthermore, as the back surface of the head body 1 is provided evenly with respect to the back surface 6A of the weight 6, there will be no obstacles to the view in the back portion of a club head, so that a player can enhance his concentration in addressing balls.

In addition, since the back surface of the head body 1 is formed annular such that the entire periphery thereof is thickened as illustrated by the thickened portion 1A, titanium, aluminium or the alloy thereof can be disposed in the back periphery of the face 2, thus realizing well-dispersed weight distribution. Consequently, if a player strikes a ball slightly off the center of the face 2, he can still be free from unsteadiness of the head when striking a ball due to the excellent dispersion of weight distribution.

Figure 4:
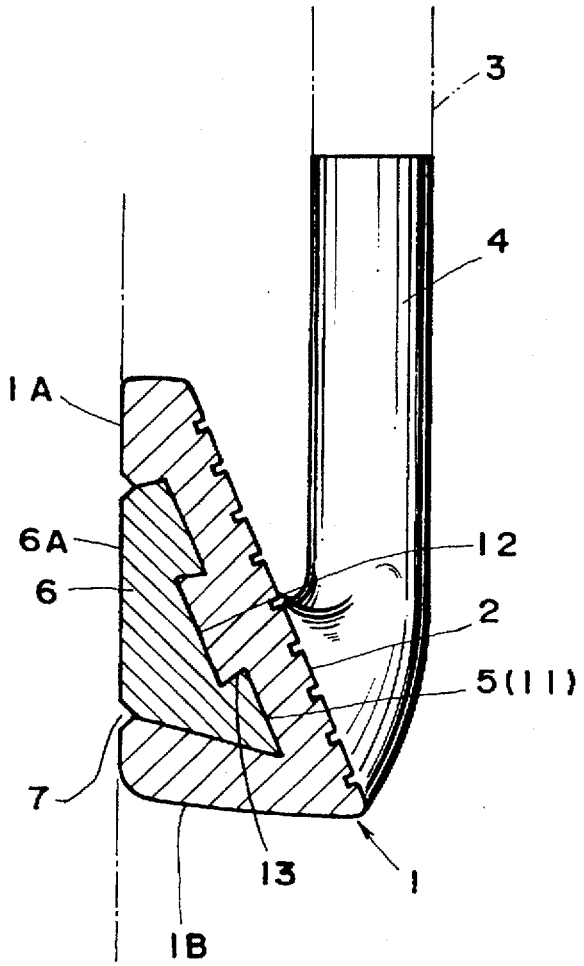
FIG. 4 is a section showing a second embodiment of the invention.
Figure 5:
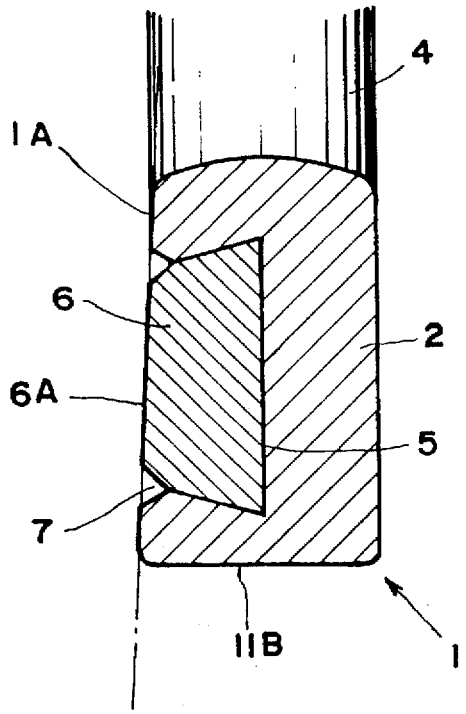
FIG. 5 is a section showing a third embodiment of the invention.

In FIGS. 4 and 5 showing second and third embodiments of the invention respectively, the same portions as those described in a first embodment will be designated as common reference numerals, and their repeated detailed description will be omitted.

In a second embodiment, there is provided convex portion 12 protruding backward from approximately the center of bottom surface 11 of concave portion 5 formed in head body 1. The cross-width defined by side surface 13 of the convex portion 12 generally increases toward the back, i.e., formed reverse-tapered, so that weight 6 can be also secured by this dovetail-shaped convex portion 12. Similarly to a first embodiment, back surface 1A of the head body 1 is formed on the same plane relative to back surface 6A of the weight 6. Accordingly, in this embodiment, the weight 6 can allow the depth of CG to be greater, and there will be no obstacles to the player's view in the back portion of a club head, so that he can enhance his concentration in addressing balls as well.

In FIG. 5 showing a third embodiment of the invention, the same structure as that shown in a first embodiment is applied to a putter golf club head. That is, there is provided concave portion 5 in a head body 1, into which is pressed weight 6 denser than head body 1. Similarly, each structure shown in each foregoing embodiment can be applied to not only an iron golf club head but a putter golf club head.

Incidentally, in the preceding embodiments, any suitable combination of material for head body 1 and weight 6 may be provided.

Figure 6A:
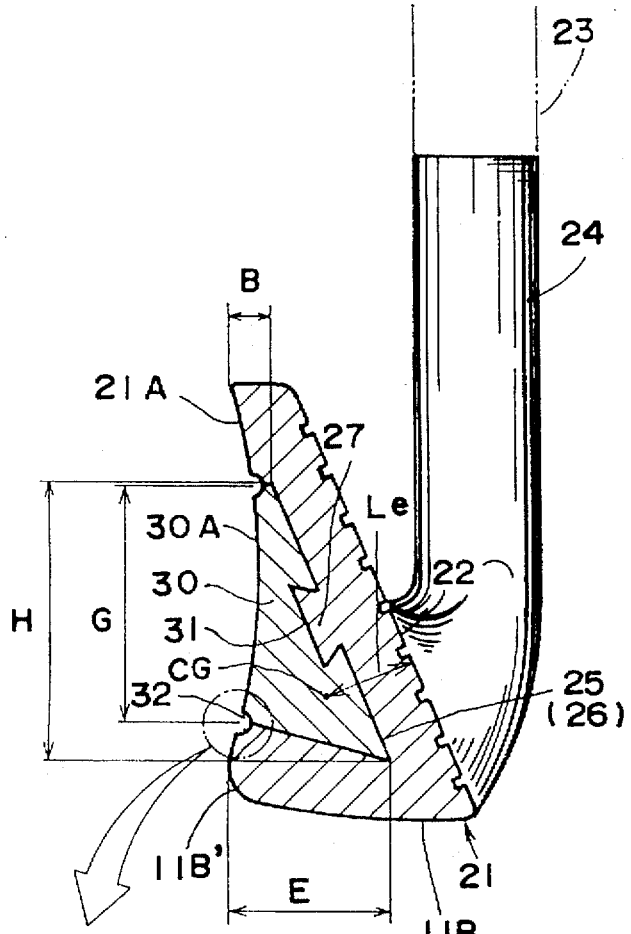
Figure 6B:
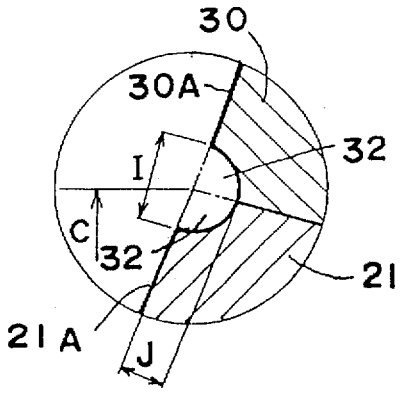

Referring to FIGS. 6 to 8 showing a fourth embodiment of the invention, reference numeral 21 designates head body made of stainless steel, copper, beryllium copper alloy or lead, having face 22 inclined at a preset angle at its front side, hosel 24 at one side for connecting shaft 23 thereto. The back of the head body 21 is formed with concave portion 25 having entire periphery of thickened portion 21A, thus forming sole 11B at its bottom side.

The depth E of a lower portion of the concave portion 25 is formed greater than the depth F of the upper portion thereof, while the height H of the inside portion greater than the height G of the outside portion thereof. There is provided protrusion 27 integral with bottom portion 26 of the concave portion 25, said protrusion 27 having reverse-trapezoid section, having wider dimension at its back side, while narrower dimension at its bottom 26 side. Balance weight 30 provided in the concave portion 25 is made of material having the less specific gravity than that of head body 21, such as titanium, aluminium or the alloy thereof, which is formed in advance slightly greater than the concave portion 25, having another concave portion 31 slightly smaller than the opposite protrusion 27.

After the balance weight 30 is pressed into the concave portion 25 by a suitable pressing device, the back surface of the head body 21 is disposed on approximately the same plane relative to back surface 30A of the balance weight 30, as illustrated in FIG. 6. More specifically, there is provided continuous concave curvature defined by the back of the head body 21 and the back surface 30A of the balance weight 30.

As to a combination of materials, since the greater difference in the specific gravity between the head body 21 and the balance weight 30 is desirable, the head body 21 may be preferably made of beryllium copper alloy., while balance weight 30 made of titanium alloy.

Referring to an enlarged section in FIG. 6, there is provided groove 32 formed by endmilling or the like, thus making clear boundary line adding the beauty, which, without such goove 32, might become unclear when securing the weight 32, as shown in a dotted line thereof. The groove 32 is arc-shaped, having a height I in section and a depth J, being colored blue, red or the like.

With the structure thus made, as the back surface of the head body 21 is located on approximately the same plane relative to the back surface 30A of the balance weight 30, a player can enhance his concentration in addressing a ball as being free from an obstacle to the view at that time. Particularly, as there is provided continuous concave curvature defined by the back of the head body 21 and the back surface 30A of the balance weight 30, he can visually confirm back end 11B' of sole 11B when addressing a ball.

Further, the back of the head body 21 is formed annular such that the entire periphery thereof is thickened as designated as thickened portion 21A, whereby denser metallic material such as stainless steel, copper, beryllium copper alloy or lead can be disposed in the periphery of the back of the head body 21. Accordingly, the head body 21 is partially weighted at the periphery of the back of face 22, thereby ensuring the accurate striking if a ball is struck slightly off the center of face 22.

In a preferred form of the invention, as the head body 21 is formed of beryllium copper alloy, while the balance weight 30 formed of titanium alloy, the difference in the specific gravity between the two members can be greater, so that excellent positioning of the CG of the head can be realized. Additionally, such position of the CG can be further fine adjusted so as to be best suited for a discrete player by adjusting the width I and depth J of the groove 32. In addition, as the groove 32 is arc-shaped in section, sand or soil is hard to choke it up, thus keeping it clean. The endmilling of the groove 32 is also advantageous in respect of accuracy and easiness in such milling.

In FIG. 9 showing a fifth embodiment of the invention, there is not provided the groove 32 of a fourth embodiment, and the back surface of the head body 21 is located on the same plane relative to the back surface 30A of the balance weight 30.

As to a combination of materials for head body 21 and balance weight 30, any suitable combination may be selected in a fourth and fifth embodiment as well as the preceding embodiments.

In FIGS. 10 to 12 showing a sixth embodiment of the invention, reference numeral 43 designates head body, which is made of stainless steel (the specific gravity 7.8), having hosel 42 for connecting shaft 41 thereto, and is formed with sole 44, heel 45 and top 46. Sole 44, heel 45 and top 46 define a face equivalent portion which has a striking face 47. Striking face 47 corresponding to face of the head body 43 is provided with through-hole 49 extending up to back face 48 of the head body 43, into which is securely inserted face member 50. The through-hole 49 is formed with stepped portions such as the first and second dovetail grooves 51 and 52. The first groove 51 has outside width K less than inside width L (K<L), while the second groove 52 has inside width M less than the inside width L (M<L). The head body 43 is formed thicker at sole 44 side than at top 46 side (i.e., N>P).

The face member 50 is made of material of the specific gravity less than that of head body 43, such as pure titanium (the specific gravity: 4.5) or titanium alloy. The front surface of the face member 50 is formed with face 50A, while the back surface thereof is formed with protrusion 50B, which reversely corresponds in shape to the through-hole 49 having dovetail grooves 51 and 52, yet formed slightly greater than the same, so that the protrusion 50B is pressed from the striking face 47 side into the through-hole 49 to be secured thereto until the back surface 53 thereof arrives through stepped portion 56 at nearly the same plane relative to the back surface 48 of the head body 43. In a preferred form of the invention, the back surface 53 is curved slightly concavely.

Reference numeral 54 is an ornament ring made of synthetic resin, which is firmly fitted into the stepped portion 56 between the back surfaces 48 and 53. The ring 54 has a circular section and is approximately pentagonal seen from the front, which is colored with suitable color other than that of the head body 43, for example, purple or the like. Reference numeral 55 designates grooves called score lines formed on face 50A.

In a preferred form of the invention, the back surface 53 of the protrusion 50B may be positioned on the same or approximately the same plane relative to the back surface 48 of the head body 43, and the thickness X of face member 50 may be at least 70% of the depth Q of the through-hole 49, more preferably 80% or above, most preferably 90% or above thereof.

Now the action and effect of a golf club head having the above-described structure will be explained.

The center of gravity CG of the head body 43 is displaced toward back and sole 44 side, owing to the greater thickness of the thickness N relative to the thickness P (N>P). Thus, the distance Le between the center of gravity CG and the face 50A can be elongated to enlarge sweet area. Further, as the head body 43 made of stainless steel having the through-hole 49 is denser than the face member 50 made of pure titanium or titanium alloy, the weight distribution of the head can be effectively dispersed toward the periphery of the head, thus further enlarging sweet area.

Furthermore, as the back surface 53 of face member 50 is formed so thick that it arrives at nearly the same plane relative to the back surface 48, the face member 50 is less subjected to elastic deformation when striking a ball, thus ensuring the enhancement of a sense of stability when striking a ball.

Additionally, as the head body 43 is made of stainless steel, while the face member made of pure titanium or titanium alloy, the difference in the specific gravity between the two members can be greater such that a ratio of the specific gravity is 1 to 0.58, thereby enlarging the depth of the CG and obtaining still dispersed weight distribution.

In addition, in this embodiment, there is provided the stepped portion 56 between the back surfaces 48 and 53, in which is securely fitted the ornament ring 54, whereby the joint line can be covered therewith to enchance the beauty. The ring 54 has the circular section free of abrupt corners, so that it will not be an obstacle to a player's concentration when addresing a ball. As the head body 43 is connected to the face member 50 by dovetail joint, the connection strength can be enhanced.

Alternatively, the head body may be made of beryllium copper alloy, while the face member made of aluminium alloy in a sixth embodiment.

What is claimed:

1. A golf club head comprising:

a head body having a front and a back, said front having a face and said back having a concave portion, said concave portion being defined by a rear surface of the head body and an entire peripheral portion of the back to form a thickened portion;

a balance weight which is secured into said concave portion, wherein said concave portion is provided with a protrusion in approximately a center of a bottom thereof, said protrusion having a width increasingly greater in a direction defined from said front to said back of said head body, so as to be securely fitted into a front side of said balance weight.

2. A golf club head according to claim 1, wherein said protrusion is securely press-fitted into said balance weight by a mortise/tenon joint.

3. A golf club head according to claim 2, wherein said peripheral portion is thickened such that a depth of said concave portion is greater at a lower side of the head body than at an upper side thereof, while a height thereof is greater at the front side of the head body than at the back side thereof.

4. A golf club head according to claim 2, wherein said thickened portion constructs a sole of the head body.

5. A golf club head according to claim 2, wherein said balance weight is denser than the head body.

6. A golf club head according to claim 2, wherein said head body is denser than said balance weight.

7. A golf club head comprising:

a head body formed with a hosel, said head body having a face-equivalent portion, corresponding to a face thereof;

a face member which is separate from said head body to be secured to said face-equivalent portion, said face member having a stepped peripheral portion of a width (L), which is larger than a corresponding width (M) of an inner periphery of said face-equivalent portion.

8. A golf club head according to claim 7, wherein said face-equivalent portion is formed with a through-hole.

9. A golf club head according to claim 8, wherein said face member has a sole side and a top side, said face member being thickened at the sole side relative to the top side.

10. A golf club head according to claim 9, wherein a back surface of said face member extends approximately up to the same plane as a rearmost surface of said head body.

11. A golf club head according to claim 10, wherein said face member is formed of a material having a specific gravity less than that of the head body.

12. A golf club head according to claim 10, wherein said face member is press-fitted into said face equivalent portion.

* * * * *